United States Patent [19]

Riegelman et al.

[11] 4,262,449

[45] Apr. 21, 1981

[54] ALUMINUM HUNG WINDOW AND TAKEOUT MECHANISM THEREFOR

[75] Inventors: Harry M. Riegelman, Diamond Bar; Vernon E. Madison, Orange, both of Calif.

[73] Assignee: Rusco Industries, Inc., Los Angeles, Calif.

[21] Appl. No.: 75,794

[22] Filed: Sep. 14, 1979

[51] Int. Cl.[3] ..... E05D 15/16

[52] U.S. Cl. ..... 49/404; 49/446; 49/453

[58] Field of Search ..... 49/453, 454, 455, 456, 49/457, 446, 463, 465, 466, 415, 404

[56] References Cited

U.S. PATENT DOCUMENTS

| | | | |
|---|---|---|---|
| 2,217,543 | 10/1940 | Gaines et al. | 49/453 X |
| 3,086,259 | 4/1963 | Klein | 49/446 X |
| 3,293,802 | 12/1966 | Fletcher | 49/453 X |
| 3,676,956 | 7/1972 | Taylor et al. | 49/454 X |
| 4,167,835 | 9/1979 | Nobes et al. | 49/453 X |

*Primary Examiner*—Philip C. Kannan
*Attorney, Agent, or Firm*—Perry E. Turner

[57] ABSTRACT

There is disclosed a single hung aluminum window in which the sash is provided with plastic inserts in its stiles at their upper and lower ends, such inserts having portions which serve as guide and spacer members which bear against the jambs of the frame in which the stiles are positioned. The inserts also form housings which include respective pushbuttons and bias springs, the buttons extending through aligned openings in such housings and the inner stile faces. In the head portion of the frame are elongated stop members adapted to be swiveled between vertical and horizontal positions, and which in vertical positions prevent upward movement of the sash beyond the point wherein it is not engaged by the feet of the balance mechanisms mounted in the jambs. When it is desired to remove the sash from the frame, the stop members are moved to horizontal positions to permit the sash to be moved upward sufficiently so that its lower end clears the feet of the balance mechanisms, such feet being captured by clips secured in the jambs. With the sash thus disengaged from the balance mechanisms, its removal is effected by depressing the pushbuttons of one stile to clear the adjacent jamb wall as the sash is moved laterally into such jamb, and the opposite stile clears the opposite jamb and can be swung free to permit the sash to be pulled free of the frame.

4 Claims, 9 Drawing Figures

ALUMINUM HUNG WINDOW AND TAKEOUT MECHANISM THEREFOR

BACKGROUND OF THE INVENTION

1. Field of the Invention

This invention relates to metal window structure, and more particularly to single or double hung windows and takeout mechanisms therefor.

2. Description of the Prior Art

It is known to provide pushbuttons mounted in the inner face of a sash stile, with bias springs in the stile to urge them outwardly so they abut the adjacent jamb wall. See U.S. Pat. No. 3,086,259 (Klein). Since the buttons engage the jamb, they are subjected to substantial impact forces each time the sash is moved quickly, with resultant damage to the buttons including breakage of the plastic material of which they are made. Also, the placement of the openings in the inner faces of the stiles to insure that pushbuttons extending therethrough will abut the jambs is a requirement that dictates considerable care in assembly of the sash. Accordingly, such takeout means is characterized by undesirably high costs of production and maintenance.

It is also known to provide spacer elements of plastic material to facilitate sash movement without metal-to-metal contact between sash and jamb. In the aforesaid patent, for example, a number of spacer buttons are secured to the sash and confronting frame portions. These numerous items, as with the individual pushbuttons and bias springs, require numerous individual hand operations for properly positioning and securing them in position. All such operations add significantly to the cost of producing such windows.

SUMMARY OF THE INVENTION

This invention embraces a window structure in which the sash of a hung metal window has plastic inserts in the ends of the stiles which serve all the functions of the numerous separate spacer, guide, glide and pushbutton takeout structures heretofore required, and which are quickly located in position with a minimum of time and labor and at considerable cost savings for producing such window structures. Such inserts are molded plastic elements which have housing portions in which respective pushbutton and bias spring elements are positioned, and spacer-guide portions which extend over the ends of the stiles to engage the adjacent jamb walls and facilitate gliding movement of the sash without metal-to-metal contact between sash and jamb. The buttons and bias springs are assembled in the inserts at the time of molding, and positioning the inserts in place in the stiles requires only the acts of depressing the buttons and effecting their movement through stile openings, and securing the inserts in place via operation of respective fastening screws or like means.

DESCRIPTION OF PREFERRED EMBODIMENTS

Figure 1:
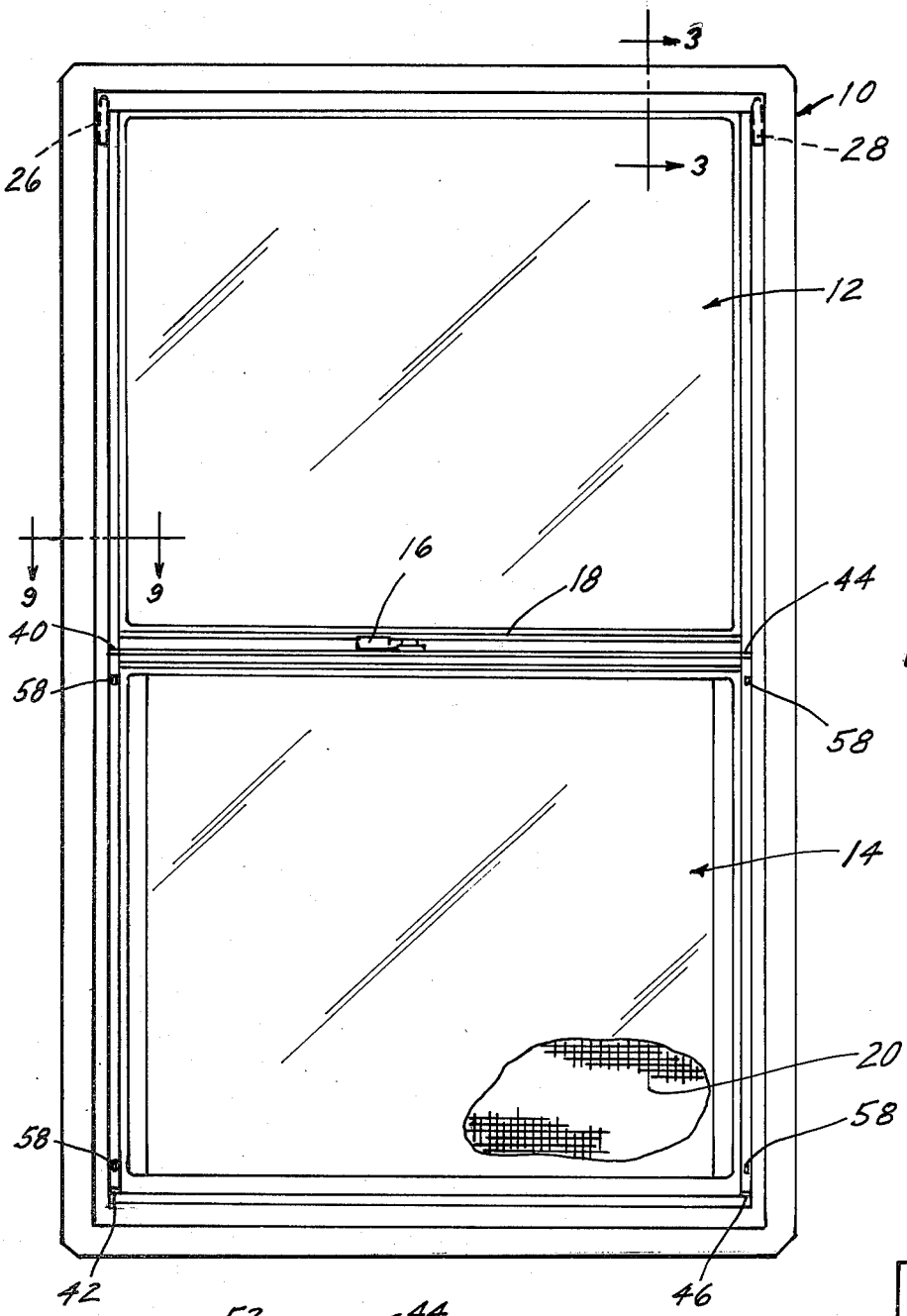
FIG. 1 is a view in elevation of the inner facing portion of a window with takeout means of the invention, wherein the sash is locked in its lower position.

FIG. 1 illustrates a single hung aluminum window wherein a frame 10 has a fixed pane 12 secured in the upper portion thereof, and a movable sash 14 slidable in the frame. The sash is adapted to be locked in its lower position, as via a cam lock 16 mounted on its upper rail and adapted to releasably lockingly engage a fixed rail 18 adjacent the lower end of the fixed pane 12. Upon turning the cam lock 16 to disengage the rail 18, the sash can be moved upward to a desired position. Preferably, a conventional screen panel 20 is fitted in the lower portion of the frame 10 for desired protection when the sash is raised.

Figure 2:
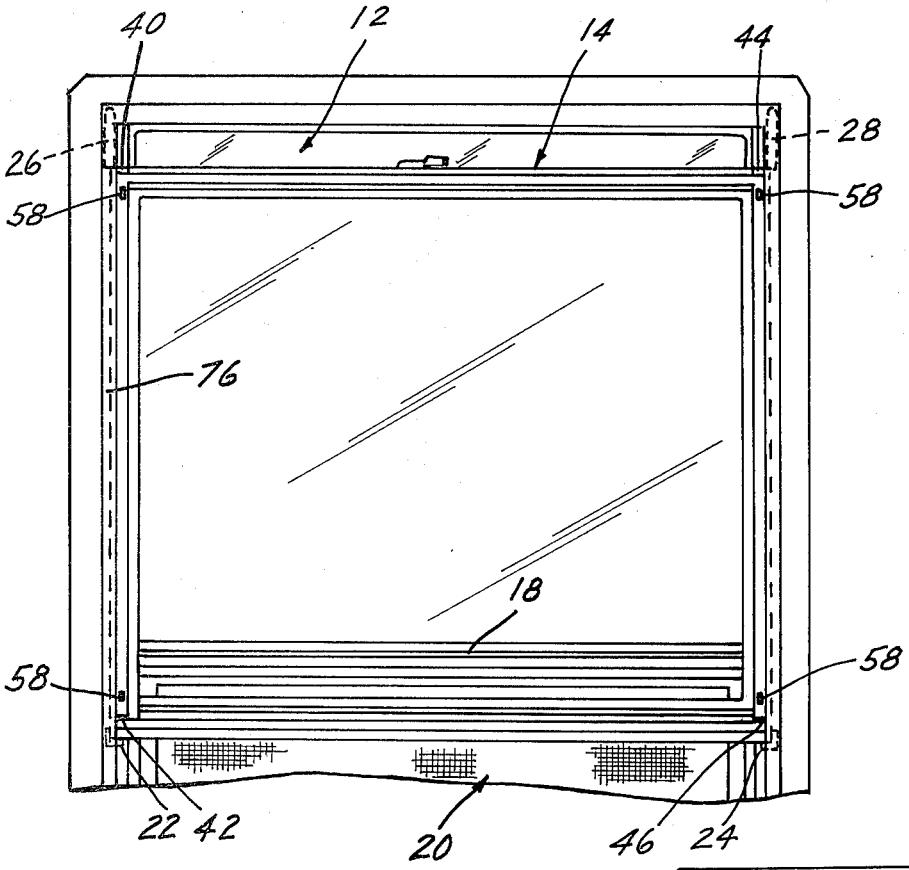
FIG. 2 is a fragmentary view in elevation of the window of FIG. 1, showing the sash in its normal uppermost position wherein vertically oriented stop elements are engaged by the sash and its lower end remains engaged by balance mechanisms in the jambs.

For normal operation, the upper limit of the sash 14 is that in which the lower end of the sash is engaged at its stiles by suitable balance mechanisms. In FIG. 2, balance feet 22, 24 are shown engaging the lower ends of the stiles. In the uppermost position of the sash in normal operation, the top of the sash has the upper ends of its stiles in abutment with the ends of vertically disposed stop elements 26, 28. As will be seen with reference to FIGS. 4 and 5 along with FIGS. 1 and 2, the stop elements 26, 28 are identical elements mounted at their upper ends so they can be swiveled to horizontal position, and will frictionally be retained in such position until forcibly moved back to vertical position.

Figure 3:
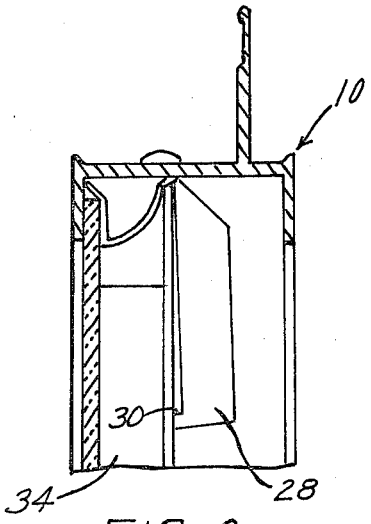
FIG. 3 is a fragmentary sectional view taken along the line 3—3 of FIG. 1.

Preferably, the stop elements are molded plastic parts, e.g., of Delrin plastic material, so they can glide easily on metal surfaces as they are moved between their two positions. As shown in FIG. 3, the lower end of each stop element is provided with a small flange 30 which serves to keep the main body of the elements spaced from the surfaces over which it moves. The flange rides on such surfaces, and thus presents a minimum of area of surface-to-surface contact to further minimize resistance to movement of the element between its positions.

Figure 4:
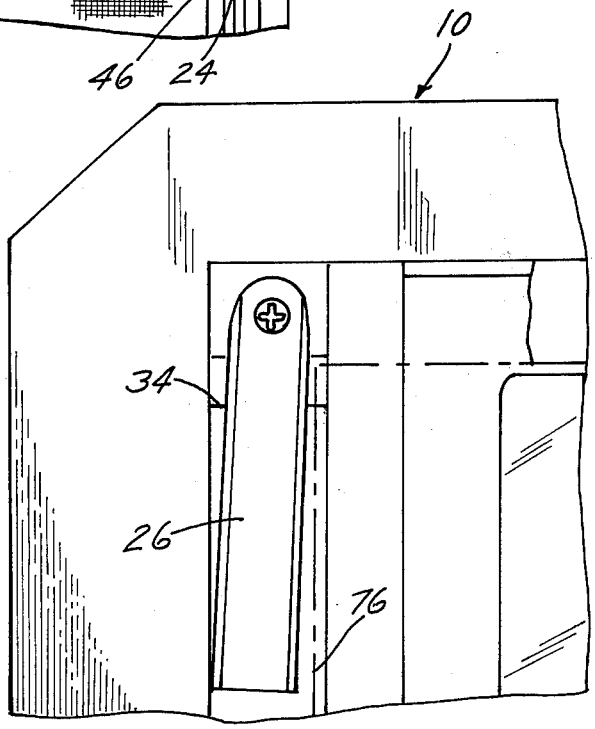
FIG. 4 is an enlarged, fragmentary view in elevation of one corner of the window structure, showing the stop element mounted for pivotal movement between vertical and horizontal.

Also, and as best seen with reference to FIGS. 3 and 4, each stop element is formed as an outwardly facing channel member. By virtue of this shape, the movable ends of the stop elements 26, 28 are readily engageable with the tip of a finger to apply force to a side wall of the channel to effect movement from one to the other of the horizontal and vertical positions.

Figure 5:
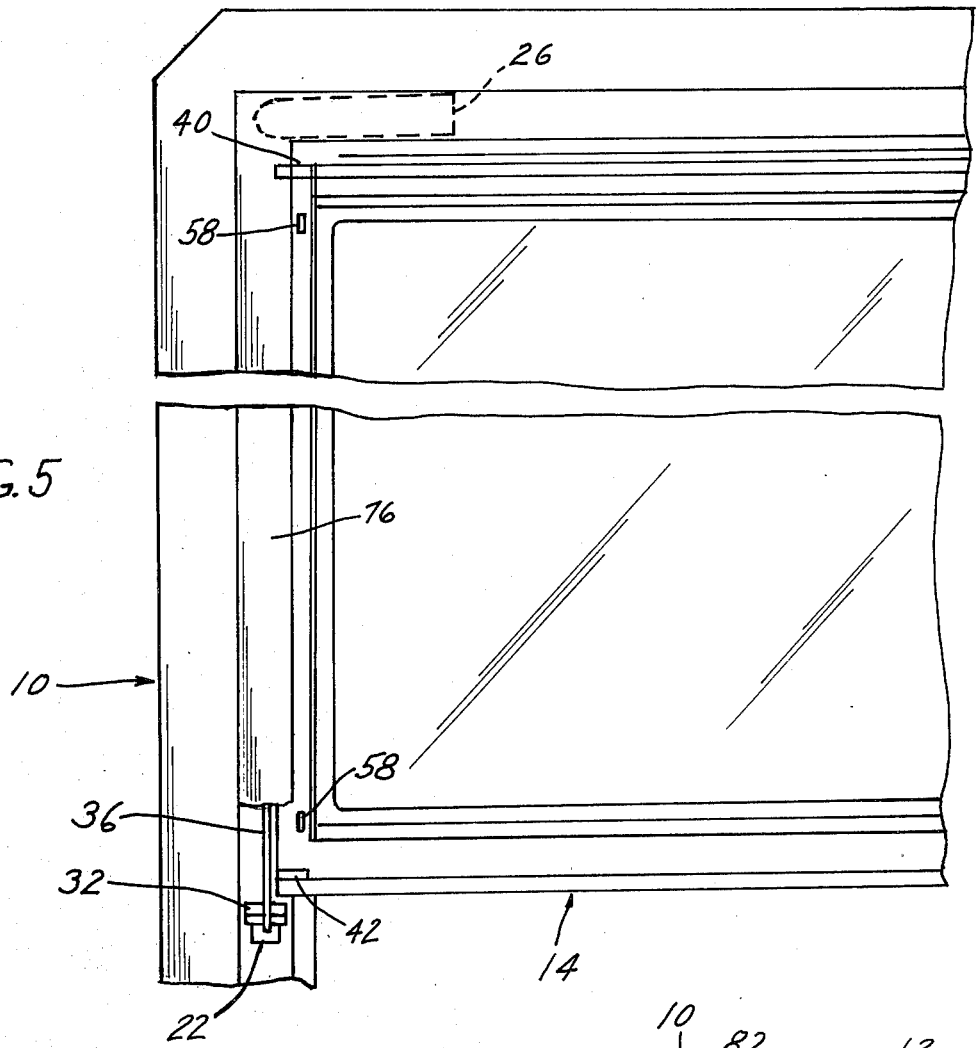
FIG. 5 is a fragmentary front elevation view of an upper portion of the window structure, showing the stop element in horizontal position and the sash moved up to a position wherein its lower end clears the foot of the balance mechanism.

When the stop elements are moved to their horizontal position, the sash 14 is free to be further elevated. Such further movement causes to sash to be disengaged from the balance feet 22, 24. In this regard, and referring to FIG. 5, the sash is shown in such elevated position wherein the balance foot is held against further travel by a suitable catch or limit stop 32 that is secured to the frame. With reference to FIGS. 3–5, the balance foot 22 is connected to a suitable balance mechanisms 34 that is mounted in the frame 10, such connection being indicated at 36 in FIG. 5 to represent a cord to a block and tackle balance or the spiral element of a spiral balance.

As will be seen, this invention is not limited to how the balance mechanism is positioned in the frame. Thus, in conventional window structures the balances are in line with the sash stiles. In our concurrently filed application, "Metal Window With Offset Sash and Balance Mechanisms", balance mechanisms are disclosed as offset, thus providing more clearance for the sash as it is maneuvered to remove it from the frame.

Figure 7:
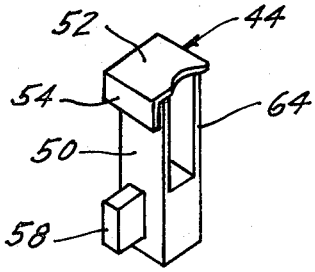
FIG. 7 is a perspective view of one of the inserts of the invention.
Figure 8:
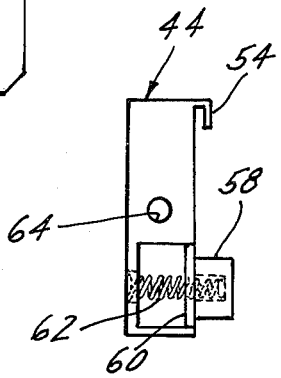
FIG. 8 is a side elevation view of the insert of FIG. 7.

The sash 14 carries means in accordance with this invention for insuring that it is properly guided and undergoes smooth gliding movement when it is raised and lowered, and for requiring specific manual operations, in addition to moving the stop elements 22, 26 to horizontal position, before it can be removed from the frame. Such means comprise inserts 40, 42, 44, 46, shown in FIGS. 1 and 2. FIGS. 7 and 8 show the insert 44, which in one example is a molded element of black Delrin plastic material. The insert has a front wall 50 past which the top wall 52 extends, the top wall terminating in a lip 54 spaced from the front wall 50. The front wall 50 and lip 54 form a groove to facilitate positioning the insert in place on one of the stiles of the sash so the lip functions as a spacer element between confronting metal portions of the sash and jamb. Also, a button 58 extends through the front wall 50. As will be noted in FIG. 8, the button 58 has a flange 60 which is in interference relation with the inner face of the wall 50, and a bias spring 62 extends from the rear wall 64 of the insert into the button 58 to normally urge the button to its outermost position wherein the flange 60 abuts the wall 50. Such insert may be molded with an opening 64 through which a screw fastener (not shown) may be passed for securing the insert to the end face of the sash.

Figure 6:
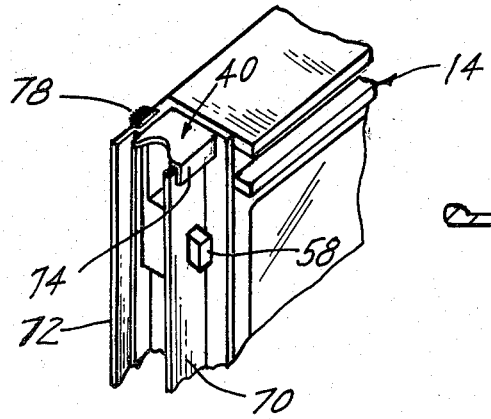
FIG. 6 is a fragmentary perspective view of the upper portion of the sash at one end thereof.
Figure 9:
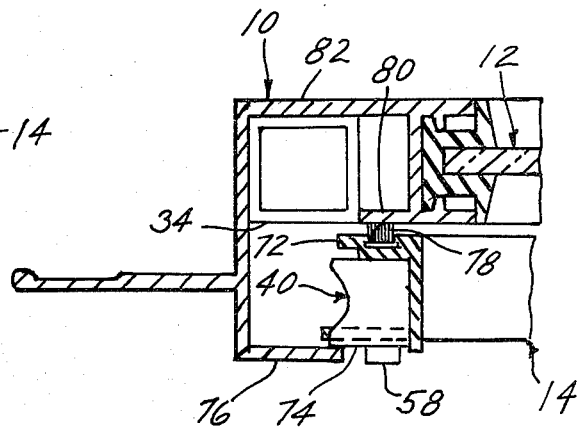
FIG. 9 is a fragmentary sectional view taken along the line 9—9 of FIG. 1.

In this latter regard, FIG. 6 illustrates the insert 40 in place at the upper end of the left stile of the sash 14. As shown, the stile is formed as a channel having inner and outer walls 70, 72, and the insert 40 is located between the walls with the front face of the insert bearing against the inner surface of the wall 70. The lip 74 of the insert extends over the top of the wall 70. The lip 74, as will be observed in FIG. 9, bears against the inner surface of the inner wall 76 of the jamb. Further in this regard, the wall 72 of the stile is fitted with a weatherstrip 78 which is adapted to ride against the confronting surface of an interior rib 80 extending from the outer wall 82 of the jamb. Thus, as the sash is raised or lowered, a weatherseal is maintained throughout the length of the sash to protect against the entry of dirt and moisture. The lip 74 of the insert 40 keeps the metal stile of the sash spaced from the metal jamb, and insures smooth gliding action of the sash as it moves. It will be apparent that the lips of all four inserts 40, 42, 44, 46 coact to keep the sash properly spaced and smoothly operable, to the end that it is guided easily along the jamb as it is raised and lowered.

The buttons 58 of the inserts 40, 42, 44, 46 in the assembled window structure normally extend past the plane of the outer faces of the jambs 76. Also, the buttons are slightly spaced from the inner edges of the jambs. As the sash is raised or lowered, the buttons do not ride against the jambs unless the sash is subjected to lateral movement. In such case, one or both buttons on the affected side of the sash will engage the adjacent jamb and nullify such lateral movement.

To remove the sash after it is moved to the position shown in FIG. 5, the buttons 58 on one side of the sash are depressed so they can enter the adjacent jamb. Such entry is effected by moving the sash toward such adjacent jamb, thereby causing the affected stile to be moved further into such jamb, as indicated by the phantom position shown for the insert 40 in FIG. 9. Such movement suffices to bring the opposite stile clear of the other jamb, whereupon the sash is removed by swinging the opposite stile inwardly of the frame while pulling the sash away from the jamb into which the depressed buttons were inserted.

It will be observed that the inserts illustrated are molded so that the outer edges of their top walls are concave. This constructions serves as an aid in mounting the inserts in place. In this regard, in this particular form of insert, the buttons are not centered in the front walls of the inserts. Rather, they are positioned nearest the sides of the inserts that are secured to the sash. Thus, the insert 40 and insert 44 are mirrors of each other, and also the inserts 40,46 and 42, 44 are alike. Accordingly, in assembly of the sash, it is a simple matter to sight the location of the insert's button 58 and the location of the concave edge, and position the insert properly at the corner where it belongs.

We claim:

1. A metal window structure comprising:
- a vertical frame having jambs for a sash;
- a sash having stiles extending into said jambs;
- a plastic member attached at each corner of each stile,
  - each plastic member having a portion located between the stile and adjacent jamb to form a spacer preventing metal-to-metal contact between jamb and stile,
  - each plastic member having a housing portion;
- a respective button element located in each housing portion and extending through one wall thereof,
- a compression spring located in each housing portion and extending between the button and the opposing wall thereof,
  - and said stiles having openings aligned with the buttons of said housing portions,
  - said springs normally biasing said buttons so they extend through said stile openings,
    - said buttons as extended being in interference relation with the adjacent jambs to prevent lateral movement of the sash for takeout purposes.

2. The combination of claim 1, including a balance mechanism in each jamb with a foot structure normally engaging the lower end of a stile of said sash;
- a stop element in each jamb to be engaged by a foot structure in a predetermined position of the sash;
- and a stop element in each jamb adjacent the top thereof movable between a vertical position in which the sash cannot be disengaged and a horizontal position in which to disengage the sash.

3. The combination of claim 2, wherein each stile is a channel with parallel walls,
- the plastic members being disposed in said channels,
- said portion of each plastic member that forms a spacer being a lip at one end thereof that overlays the end of one wall of the associated stile, said frame having wall portions which are confronted by the remaining walls of the stiles;

and respective weatherstrips carried by said remaining stile walls and being in slidable sealing engagement with said wall portions of said frame.

4. A combination spacer and takeout device for a window sash comprising:

an elongated plastic housing having parallel front and back walls and top and bottom walls, said top wall having an extension from which depends a rib spaced from said front wall a predetermined distance sufficient to permit said extension to be hooked over the end of a sash stile, said front wall having an opening located adjacent said bottom wall;

a plastic button extending through said opening, the portion of said button inside said front wall having a flange in interference relation with said front wall;

and a compression spring extending between said button and said back wall normally urging said button to a position wherein said flange abuts the inner surface of said front wall.

* * * * *